United States Patent [19]

Ikesue et al.

[11] Patent Number: 4,641,945

[45] Date of Patent: Feb. 10, 1987

[54] DEVELOPER SUPPLY DEVICE FOR DRY PROCESS ELECTROPHOTOGRAPHIC COPIER

[75] Inventors: Masumi Ikesue, Tokyo; Takashi Ikeda, Sagamihara, both of Japan

[73] Assignee: Ricoh Company, Ltd., Tokyo, Japan

[21] Appl. No.: 596,198

[22] Filed: Apr. 2, 1984

[30] Foreign Application Priority Data

Apr. 9, 1983 [JP] Japan ..... 58-63438

[51] Int. Cl.[4] ..... G03G 15/08

[52] U.S. Cl. ..... 355/3 DD; 141/320; 222/325; 222/DIG. 1

[58] Field of Search ..... 355/3 R, 3 DD; 222/DIG. 1, 167, 325, 564; 141/320, 364, 366

[56] References Cited

U.S. PATENT DOCUMENTS

| | | | |
|---|---|---|---|
| 3,703,860 | 11/1972 | Wilkinson | 354/329 X |
| 4,089,601 | 5/1978 | Navone | 355/3 DD X |
| 4,344,692 | 8/1982 | Oda | 355/3 DD |

*Primary Examiner*—Fred L. Braun

*Attorney, Agent, or Firm*—David G. Alexander

[57] ABSTRACT

A toner supply device for supplying a developing unit of an electrophotographic copier with a toner developer which is stored in a cylindrical cartridge. The cartridge is fixed in a horizontal position in the vicinity of the developing unit of the copier while occupying a minimum of space. The toner supply device is desirably applicable to a small-size electrophotographic copier.

3 Claims, 9 Drawing Figures

DEVELOPER SUPPLY DEVICE FOR DRY PROCESS ELECTROPHOTOGRAPHIC COPIER

BACKGROUND OF THE INVENTION

The present invention relates to a device installed in an electrophotographic copier with a dry process developing unit for supplying a toner or like developer to the developing unit.

One of toner supply devices heretofore proposed for use with dry process electrophotographic copiers employs a cartridge which is held by a toner container and turned upside down to let the toner to fall by gravity into the toner container. In another type of prior art toner supply devices, a hollow cylindrical cartridge is formed with a slot and turned over within a toner container to supply the toner. In still another type of prior art toner supply devices, a cartridge with a generally L-shaped pipe attached thereto is arranged to supply a toner while being rotated about an axis thereof.

A drawback encountered with the first-mentioned type of toner supply device is that a substantial space for housing the cartridge is required in an upper portion of the developing unit in order to place the cartridge upside down and, accordingly, the device is inapplicable to a small-size copier which has a developing unit in an upper portion of its body. The second-mentioned cylindrical cartridge type device cannot have its slot widened beyond a certain limit because of the need for sealing, blocking tending to occur in the slot. The cylindrical cartridge, therefore, has to be sufficiently shaked before use. Further, the third-mentioned type of device using an L-shaped pipe requires the cartridge to be held face down resulting in a severe space requirement as in the case of the first-mentioned type. Additionally, this type of device with the L-shaped pipe fails to be fully unloaded and tends to smear the hands in the event of replacement.

SUMMARY OF THE INVENTION

It is therefore an object of the present invention to provide a new and improved toner supply device which is capable of supplying a toner always stably and surely to an electrophotographic copier which is equipped with a dry process developing unit.

It is another object of the present invention to provide a toner supply device which is readily attachable to and detachable from a dry process developing unit which is mounted in an upper portion of a body of an electrophotographic copier of the type having only a relatively limited space.

It is another object of the present invention to provide a toner supply device for an electrophotographic copier with a dry process developing unit which remarkably reduces the frequency of replacement of a toner cartridge.

It is another object of the present invention to provide a generally improved toner supply device for an electrophotographic copier with a dry process developing unit.

A developer supply device for an electrophotographic copier which includes a dry process developing unit for developing an electrostatic latent image on a photoconductive element by means of a dry process developer of the present invention comprises a rotatable cylindrical developer cartridge having a spiral toner guide member on an inner peripheral wall thereof and a mouth for developer supply at one end thereof, and developer cartridge holder means for holding the developer cartridge such that the mouth of the developer cartridge communicates with a developer inlet openings of the developing unit, the cartridge holder means being movable angularly about an axis of the developer inlet opening to selectively fix the cartridge held by the cartridge holder means in at least a vertical position and a horizontal position inside the copier.

The above and other objects, features and advantages of the present invention will become apparent from the following detailed description taken with the accompanying drawing.

DESCRIPTION OF THE PREFERRED EMBODIMENT

While the toner supply device for an electrophotographic copier of the present invention is susceptible of numerous physical embodiments, depending upon the environment and requirements of use, a substantial number of the herein shown and described embodiment have been made, tested and used, and all have performed in an eminently satisfactory manner.

To facilitate understanding of the present invention, a brief reference will be made to some prior art toner supply devices, illustrated in FIGS. 1A–1D.

Figure 1A:
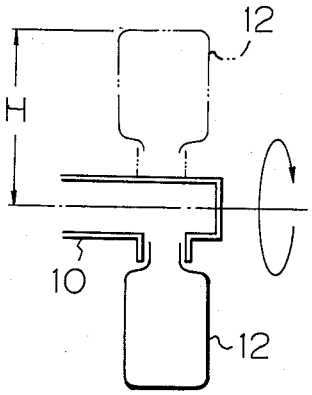
Fig. 1A PRIOR ART
FIGS. 1A–1D are schematic views respectively showing prior art toner supply devices.
Figure 1B:
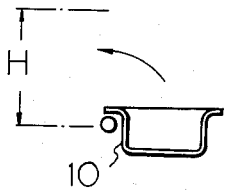
Fig. 1B PRIOR ART
Figure 1C:
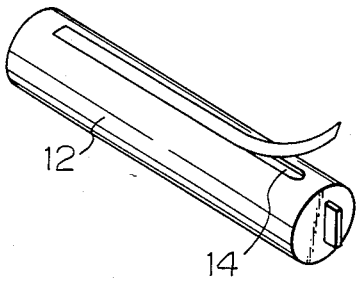
Fig. 1C PRIOR ART
Figure 1D:
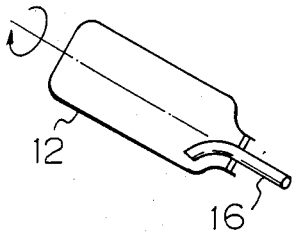
Fig. 1D PRIOR ART

In FIG. 1A or 1B, a toner supply device is shown in which a cartridge 12 mounted on a toner container 10 is placed upside down so that a toner may be let fall into the container 10 by gravity. In FIG. 1C, a cylindrical cartridge 12 having a slot 14 formed therethrough is turned over inside a toner container to supply a toner. Further, in FIG. 1D, a cartridge 10 with a generally L-shaped pipe mounted therein is caused to rotate to supply a toner.

However, as previously described, the device of the type shown in FIG. 1A or 1B which positions the cartridge upside down needs a substantial space H in an upper portion of a developing unit for accommodating the cartridge and, therefore, it is inapplicable to, among others, a small-size copier in which a developing unit is located in an upper portion of its body. The cylindrical cartridge type of device shown in FIG. 1C tends to cause blocking along the slot because the slot cannot be large due to the need for sealing; it cannot be used unless sufficiently shaked consuming time and labor. The device with the L-pipe shown in FIG. 1D also suffers from the severe space requirement because the cartridge has to be held face down. Other drawbacks particular to the device with the L-pipe are that the toner cannot be fully fed out of the cartridge, that it tends to smear the hands at the time of replacement, etc.

A toner supply device embodying the present invention which is free from the drawbacks discussed above will be described in detail with reference to FIGS. 2–6.

Figure 2:
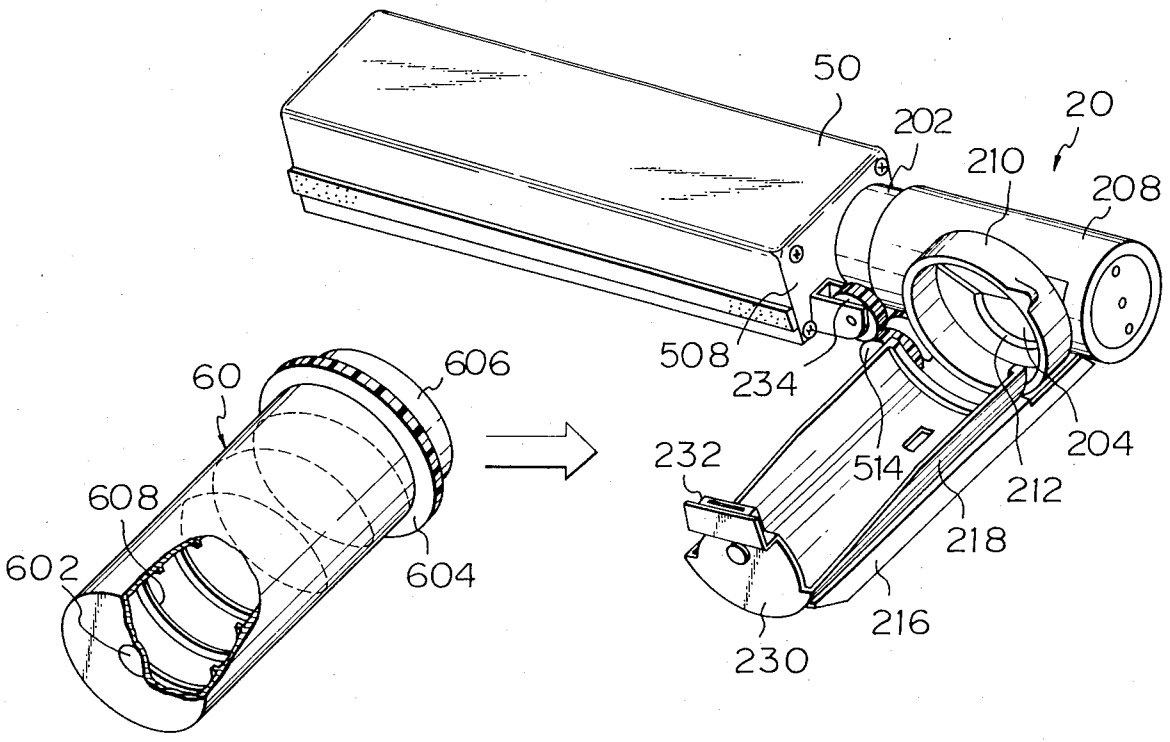
FIG. 2 is a perspective view of a toner supply device embodying the present invention.
Figure 3:
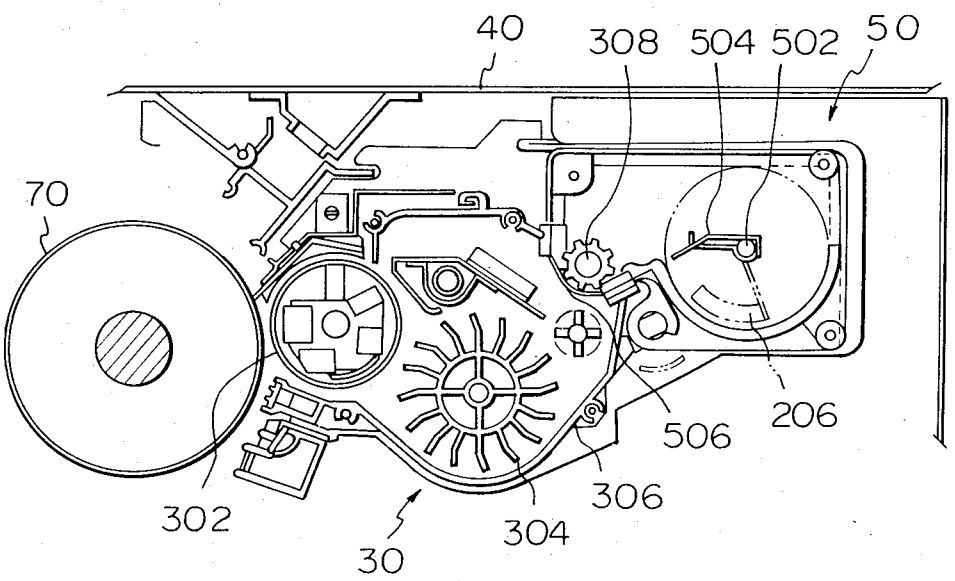
FIG. 3 is a side elevation indicative of a relationship between the toner supply device of FIG. 2 and a developing unit.

Referring to FIG. 2, a toner supply device or unit embodying the present invention is shown and generally designated by the reference numeral 20. The toner supply unit 20 is mounted on one side of a developing unit 30 which is shown in FIG. 3. In FIG. 3, the developing unit 30 is an ordinary dry process developing unit which has a developing roller 302, a bladed wheel 304 and the like arranged thereinside. The copier has a housing 40 in an upper portion of which is disposed a casing 306 for accommodating the developing unit. A toner container 50 extends above and along the length of the casing 306. A shaft 502 extends throughout the interior of the toner container 50, while an agitator 504 for agitating the toner is associated with the shaft 502. The toner container 50 communicates with the developing unit 30 at an opening 506 thereof. Rotatably disposed in the opening 506 is a toner supply roller 308 which will be rotated by an output signal of a toner density sensor (not shown).

Now, the toner supply unit 20 which constitutes a characteristic feature of the present invention is mounted on one end of the toner container 50. The unit 20 holds a toner cartridge, which will be described, and rotates it in unison with the toner supply roller 308, so that the toner stored therein may be sequentially fed out from one end of the toner container 50.

Figure 5:
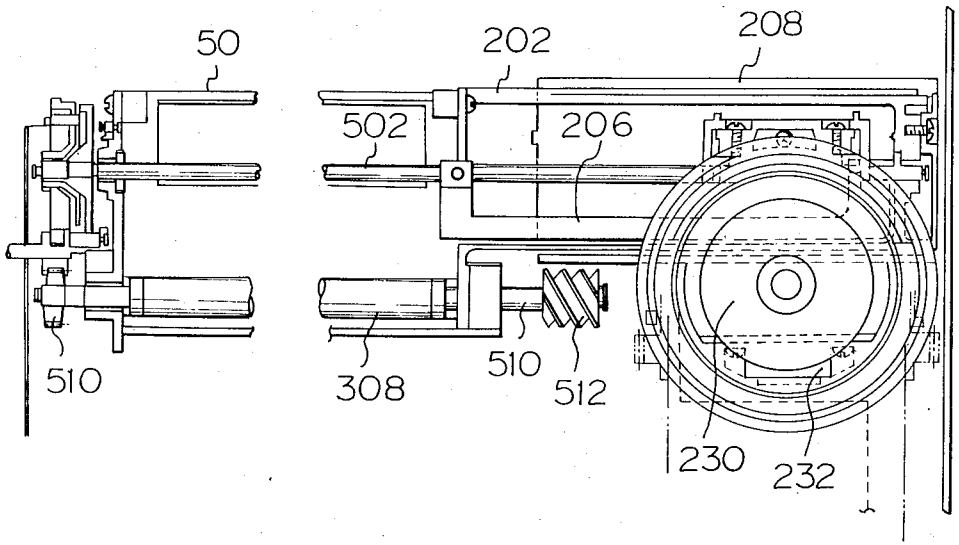
FIG. 5 is a top plan view of the toner supply device shown in FIG, 2.
Figure 6:
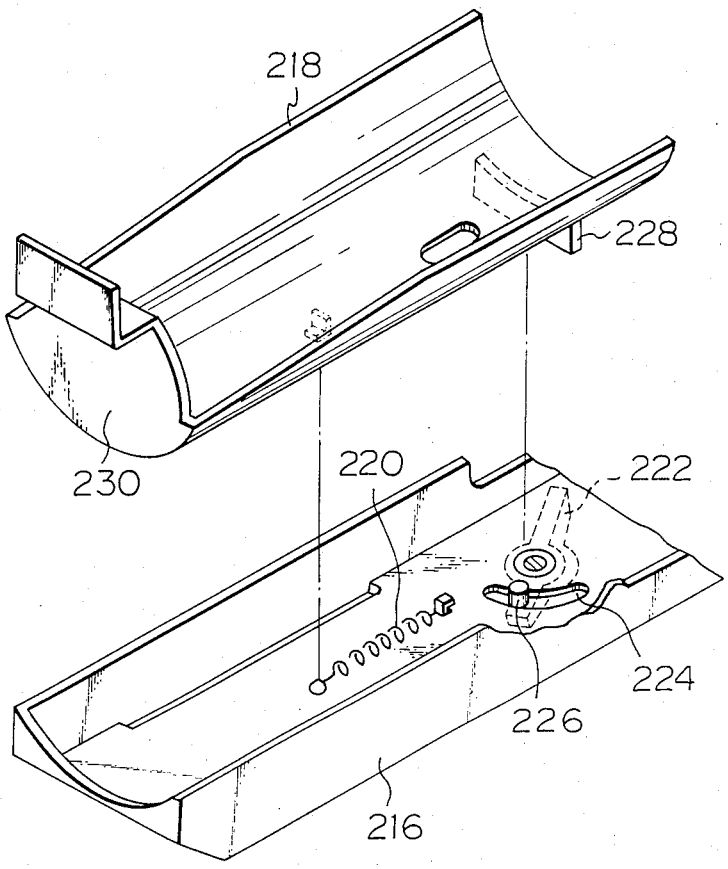
FIG. 6 is a fragmentary exploded perspective view of the toner supply device shown in FIG. 2.

In detail, the toner container 50 has a tubular extension 202 on a side wall thereof which is accessible for manipulation. The shaft 502 extending out from the toner container 50 extends throughout and along the center of the tubular extension, or tube, 202. The shaft 502 carries therewith a spiral toner feed plate 206 (FIGS. 3–5) adapted to feed into the toner container 50 the toner which is introduced through a toner inlet opening 204, which is formed through a side wall of the tube 202. A support sleeve 208 rotatably surrounds the tube 202 and carries integrally therewith a stop 210 on a side thereof. The stop 210 is adapted to support the mouth of a toner cartridge air-tight and rotatably. The stop 210 is formed with an opening 212 which is open to the side wall of the tube 202. When the stop 210 is rotated to its horizontal position, the opening 212 will be aligned with the above-mentioned toner inlet opening 204. An arm 216 for holding a cartridge is fixed to the stop 210 by means of a screw 214. As shown in FIG. 6, a tray 218 is loaded on the arm 216 while being constantly biased toward the stop 210 by a tension spring 220, which is anchored to the tray 218 and the arm 216. A knob 222 is positioned on the underside of the arm 216 to be rotatable so that a pin 226 protruding from the bottom of the arm 216 via an arcuate slot 224 may be engaged with a leg 228 to move the tray 218 up and down.

An upright bottom plate 230 extends from an end of the tray 218 so as to support a radially central area 602 of the bottom of a toner cartridge 60. Attached to the bottom plate 230 is a permanent magnet 232 which will magnetically cooperate with a magnetic locking section 402 (FIG. 4) of the copier housing 40 to maintain the toner cartridge 60 held in the horizontal position.

A pinion 234 meshes with a gear 604 on the toner cartridge 60 which is laid on the tray 218, when the arm 216 is rotated to a horizontal position. A worm gear 512 is mounted on an end of a toner supply roller shaft 510 which protrudes from the side wall of the toner container 50. The worm gear 512 imparts a torque to the pinion 234 via an idler 514 so that the toner cartridge 60 is rotated in synchronism with the toner supply roller 308.

Figure 4:
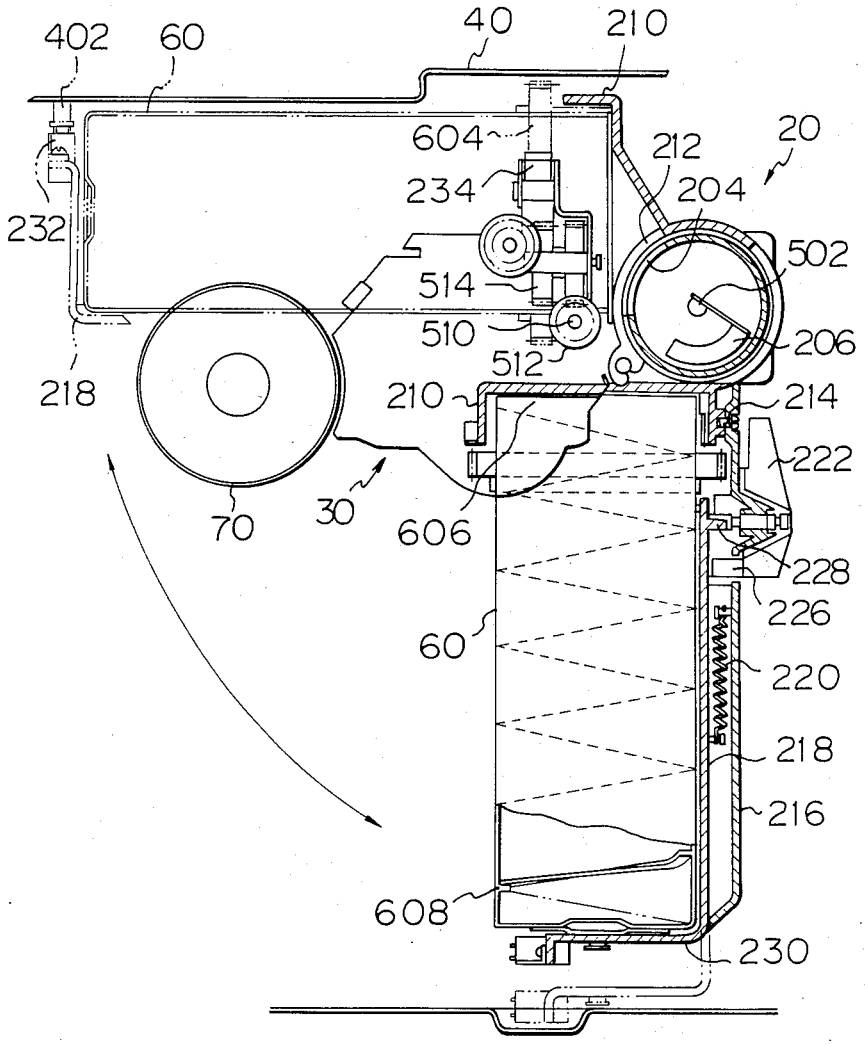
FIG. 4 is a side elevation of the toner supply device shown in FIG. 2.

Concerning the toner cartridge 60 to be mounted on the tray 218, it is made of resin as a generally cylindrical one-way container. As shown in FIGS. 2 and 4, a spiral rib 608 extends along the inner peripheral wall of the cartridge 60 so as to guide the toner toward a mouth 606, while a flange-like gear 604 is positioned in the neighborhood of the mouth 606 to mesh with the pinion 234. The rib 608 and the gear 604, each being formed integrally with the cartridge 60, bifunction to increase the mechanical rigidity of the cartridge 60.

In FIGS. 3 and 4, the reference numeral 70 designates a photoconductive drum. The toner supply roller shaft 510 in FIG. 5 is supplied with a torque from a drive source (not shown) via an electromagnetic clutch.

The toner supply device having the above construction will be manipulated as follows.

First, the arm 216 is moved downwardly about the tube 202 (solid line position in FIG. 4) and, then, the knob 222 is rotated until the pin 226 engaged with leg 228 urges the tray 218 downward (dash-and-dots line position in FIG. 4). In this condition, the toner cartridge 60 is freely removable from the stop 210. After the empty cartridge 60 has been replaced by a full one, the knob 222 is returned to the original position to release the tray 218 from the pressure exerted by the pin 226. This causes the cartridge 60 to be pressed into the stop 210 by the action of the spring 220 via the tray 218.

Thereafter, the arm 216 is rotated clockwise by 90 degrees in the drawing until the magnet 232 on the tray 218 has stuck to the locking member 402 on the copier housing 40, thereby holding the arm 216 horizontal. In this position, the gear 604 on the cartridge 60 which is placed on the tray 218 is meshed with the pinion 234. By such a rotation of the arm 216, the opening 212 of the stop 210 is brought into alignment with the toner inlet opening 204 of the tube 202 to become prepared for toner supply.

As the toner density in the developing unit 30 is lowered due to repeated development in the copier, the electromagnetic clutch is actuated by an output signal of a toner density sensor (not shown) so that the toner supply roller 308 begins to rotate. Then, the worm gear 512 mounted on the shaft 510 rotates the pinion 234 and, thereby, the cartridge 60 which is rotatably supported on the tray 218. The rib 608 spirally extending along the inner wall of the cartridge 60 gradually feeds the toner in the cartridge toward the mouth 606 in response to the rotation of the cartridge. The toner coming out of the mouth 606 of the cartridge 60 is introduced into the tube 202 via the aligned openings 212 and 204. The toner feed plate 206, which is constantly rotating on the shaft 502 inside the tube 202, drives the incoming toner into the toner container 50. Such a toner supply operation continues until the toner density in the developing unit 30 has regained a predetermined value causing the rotation of the toner supply roller 308 to stop again.

In summary, it will be seen that the present invention provides a developer supply device which can be readily installed even in a small-size copier in which a developing unit is positioned in an upper portion of a housing, because a cylindrical container having a spiral guide section thereinside is held in a horizontal position and caused to rotate by drive means to supply a toner. The device is capable of supplying the toner sequentially into a developing station while storing it in the container, thereby eliminating the need for an additional toner storage section. This will proportionally reduce the overall dimensions of the copier. A toner storage section, if equipped within a copier, will proportionally increase the capacity for toner storage to cut down the frequency of replacement of the container. Additionally, because the device of the present invention is operable only with the above-described special container for the toner supply and inhibits the use of any other different kind of cartridges, entry of a different kind of toner particles into the developing section is prevented.

Various modifications will become possible for those skilled in the art after receiving the teachings of the present disclosed without departing from the scope thereof.

What is claimed is:

1. A developer supply device for an electrophotographic copier which includes a dry process developing unit for developing an electrostatic latent image on a photoconductive element by means of a dry process developer, comprising:

a rotatable cylindrical developer cartridge having a spiral developer guide member on an inner peripheral wall thereof and a mouth for developer supply at one end thereof;

developer cartridge holder means for holding said developer cartridge such that said mouth of the developer cartridge communicates with a developer inlet opening of the developing unit, said cartridge holder means being movable angularly about an axis of the developer inlet opening to selectively fix the cartridge held by the cartridge holder means in at least a vertical position and a horizontal position inside the copier; and fixing means for fixing the cartridge in a horizontal position inside the copier;

the fixing means comprising a magnetic member mounted in a portion of the holder means and a locking member which is located in a portion of a housing of the copier to magnetically couple with said magnetic member.

2. A developer supply device for an electrophotographic copier which includes a dry process developing unit for developing an electrostatic latent image on a photoconductive element by means of a dry process developer, comprising:

a rotatable cylindrical developer cartridge having a spiral developer guide member on an inner peripheral wall thereof and a mouth for developer supply at one end thereof; and developer cartridge holder means for holding said developer cartridge such that said mouth of the developer cartridge communicates with a developer inlet opening of the developing unit, said cartridge holder means being movable angularly about an axis of the developer inlet opening to selectively fix the cartridge held by the cartridge holder means in at least a vertical position and a horizontal position inside the copier;

the developer holder means comprising a support sleeve formed with a developer outlet opening communicating with the developer inlet opening of the developing unit and a developer induction opening communicating with the mouth of the cartridge, a tray constantly biased toward said developer induction opening for holding the cartridge thereon, and a cartridge fixing member integrally connected to said support sleeve to attach and detach the cartridge to and from the tray.

3. A developer supply device of claim 2 in which the holder means further comprises a stop member formed with an opening which aligns with the mouth of the cartridge when the cartridge is in the horizontal position, said stop member being integrally connected to the support sleeve to hold the mouth of the cartridge airtight.

* * * * *